US006474485B1

(12) United States Patent
Yokoyama

(10) Patent No.: US 6,474,485 B1
(45) Date of Patent: Nov. 5, 2002

(54) CRAWLER TRAVELING TYPE WORKING MACHINE

(75) Inventor: Shozo Yokoyama, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/657,902

(22) Filed: Sep. 8, 2000

(30) Foreign Application Priority Data

Sep. 9, 1999 (JP) ..... 11-255678

(51) Int. Cl.[7] ..... B66C 23/72
(52) U.S. Cl. ..... 212/195; 212/253
(58) Field of Search ..... 212/195, 253, 212/181, 196, 197, 198

(56) References Cited

U.S. PATENT DOCUMENTS

| | | | | | |
|---|---|---|---|---|---|
| 2,134,866 | A | * | 1/1938 | Esters | 212/253 |
| 2,144,760 | A | * | 1/1939 | Harnischfeger | 212/253 |
| 3,051,325 | A | * | 8/1962 | Risto | 212/195 |
| 3,662,623 | A | * | 5/1972 | Lorence | 74/805 |
| 3,763,946 | A | * | 10/1973 | Termont | 180/9.2 |
| 4,018,473 | A | * | 4/1977 | Chalupsky | 296/28 C |
| 4,195,740 | A | * | 4/1980 | Beduhn et al. | 212/66 |
| 4,231,699 | A | * | 11/1980 | Thompson | 212/253 |
| 4,381,060 | A | * | 4/1983 | Morrow et al. | 212/195 |
| 5,176,267 | A | * | 1/1993 | Pech | 212/253 |
| 5,671,932 | A | * | 9/1997 | Chapman | 212/195 |
| 6,131,751 | A | * | 10/2000 | Pech et al. | 212/195 |
| 6,135,175 | A | * | 10/2000 | Gaudreault et al. | 180/9.5 |

FOREIGN PATENT DOCUMENTS

| | | | | |
|---|---|---|---|---|
| DE | 2507476 | * | 8/1976 | 212/195 |
| DE | 2841378 | * | 4/1980 | |
| DE | 3718800 | * | 12/1988 | |
| GB | 398201 | * | 9/1933 | 212/195 |
| JP | 2000-45336 | * | 2/2000 | |
| SU | 1521705 | * | 11/1989 | 212/195 |
| SU | 1781161 | * | 12/1992 | 212/195 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A crawler traveling type working machine, comprising: a lower traveling body provided with crawlers on left and right sides; an upper rotating body mounted on the lower traveling body through a rotating means, the upper rotating body having a first counter weight; and a second counter weight interposed between an upper part of the lower traveling body and the rotating means. With this constitution, the stability of the working machine is excellent, the obstacle avoiding function when the upper rotating body rotates is excellent, and the rear rotating radius is smaller than the normal working machine of an upper class. Therefore, the working machine can be used as a working machine of an upper class.

6 Claims, 5 Drawing Sheets

CRAWLER TRAVELING TYPE WORKING MACHINE

BACKGROUND OF THE INVENTION

1. Field of the Invention

The present invention relates to a crawler traveling type working machine.

2. Description of the Related Art

For work such as hanging, excavation of longitudinal holes, excavation of earth and sand, piling and the like, a crawler traveling type working machine having the following constitution is being used. That is, an upper rotating body provided with a counter weight is mounted through a rotating bearing on a lower traveling body provided with crawlers on left and right sides, and a winch for winding up and rewinding a rope is mounted on the upper rotating body. On the upper rotating body are mounted various attachments according to the kind of work, for example, such as a hook, a hammer grab, a continuous bucket, an earth drill, an earth auger, a vibro-hammer, a clamshell bucket, and the like. For performing various works, normally, a working machine of class (size) according to the scale of work is used. The above-described various attachments are supported on the upper rotating body of the working machine through a boom, tower or a leader.

Incidentally, where a field is located at a narrow ground (which has tendency to be increased gradually), a working machine of class (size) according to the scale of work cannot be used, thus posing a problem of lowering the work efficiency. Further, even if a field is not located at a narrow ground, and a working machine of class according to the scale of work can be used, it is necessary, in carrying, to disassemble the working machine, carrying it to a field, and assemble at the field, in accordance with the Regulations of bulging out of a trailer in carrying (Road Transport Vehicle Law). This poses a problem of making a carrying expense high. In addition, there was an economical problem in that for example, if the working machine is large, the maintenance cost of the working machine is totally different due to a difference in class of one rank.

SUMMARY OF THE INVENTION

It is an object of the present invention to provide a compact crawler traveling type working machine of providing with an ability of at least one class up and capable of reducing the amount of disassembling work in carrying.

A crawler traveling type working machine according to the present invention comprises a lower traveling body provided with crawler on left and right sides, an upper rotating body having a first counter weight mounted on the lower traveling body through a rotating means, and a second counter weight interposed between an upper part of the lower traveling body and the rotating means.

In this case, since the second counter weight is interposed between the upper part of a car body of the lower traveling body and the rotating means, the stability of the working machine is improved. Further, since the upper rotating body is at a higher position so that a height on the ground of the counter weight is high, an obstacle avoiding function when the upper rotating body rotates is improved. And, since the rear rotating radius is smaller than the normal working machine of an upper class, the working machine can be used as a working machine of an upper class even in the narrow ground. Since the body of the working machine is more compact than the normal working machine of an upper class, the amount of disassembling work in carrying is as much as that of lower class, thus reducing carrying costs, and the maintenance costs of the working machine can be also as much as that of lower class.

In the present invention, preferably, the lower surface of the second counter weight is set to a position higher than the upper surface of the crawler of the lower traveling body.

In this case, the left and right crawlers can be retreated without being interfered by the second counter weight. Accordingly, the left and right crawlers can be retreated to prevent from bulging from the width of a trailer, and the amount of disassembling work in carrying can be reduced.

In the present invention, an auxiliary counter weight is provided on the first counter weight provided on the upper rotating body.

In this case, the stability of the working machine can be further improved.

Further, in the present invention, preferably, where a winch for winding up and rewinding a rope is mounted on the upper rotating body, the ability of the winch is set to a higher ability than that of the winch according to the size of the body of the working machine.

In this case, although the working machine is compact, the working ability of an ordinary working machine of an upper class can be given.

DESCRIPTION OF THE PREFERRED EMBODIMENTS

Figure 1A:
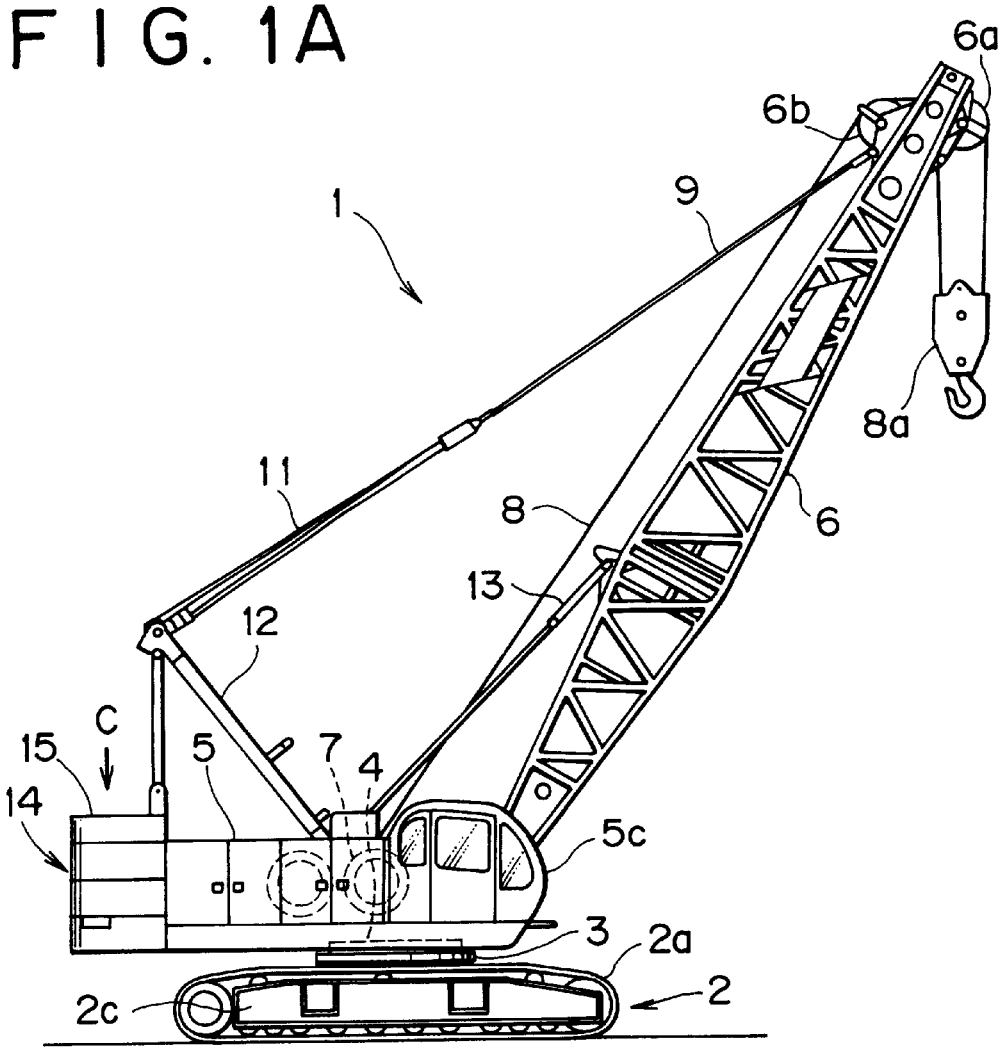
FIG. 1A is a side view of the whole crawler crane according to the present invention, and FIG, 1B is a front view of the crawler crane showing a state that a boom is removed.

The present invention will be described in detail hereinafter on the basis of the embodiments shown in the drawings.

Figure 1B:
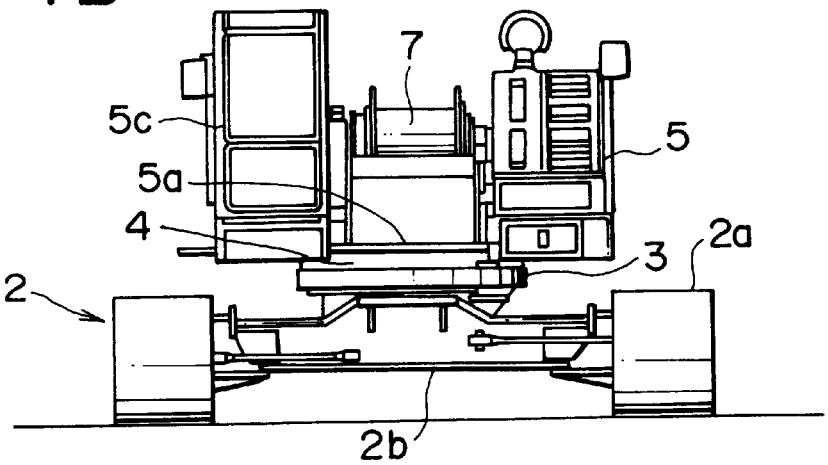
Figure 2:
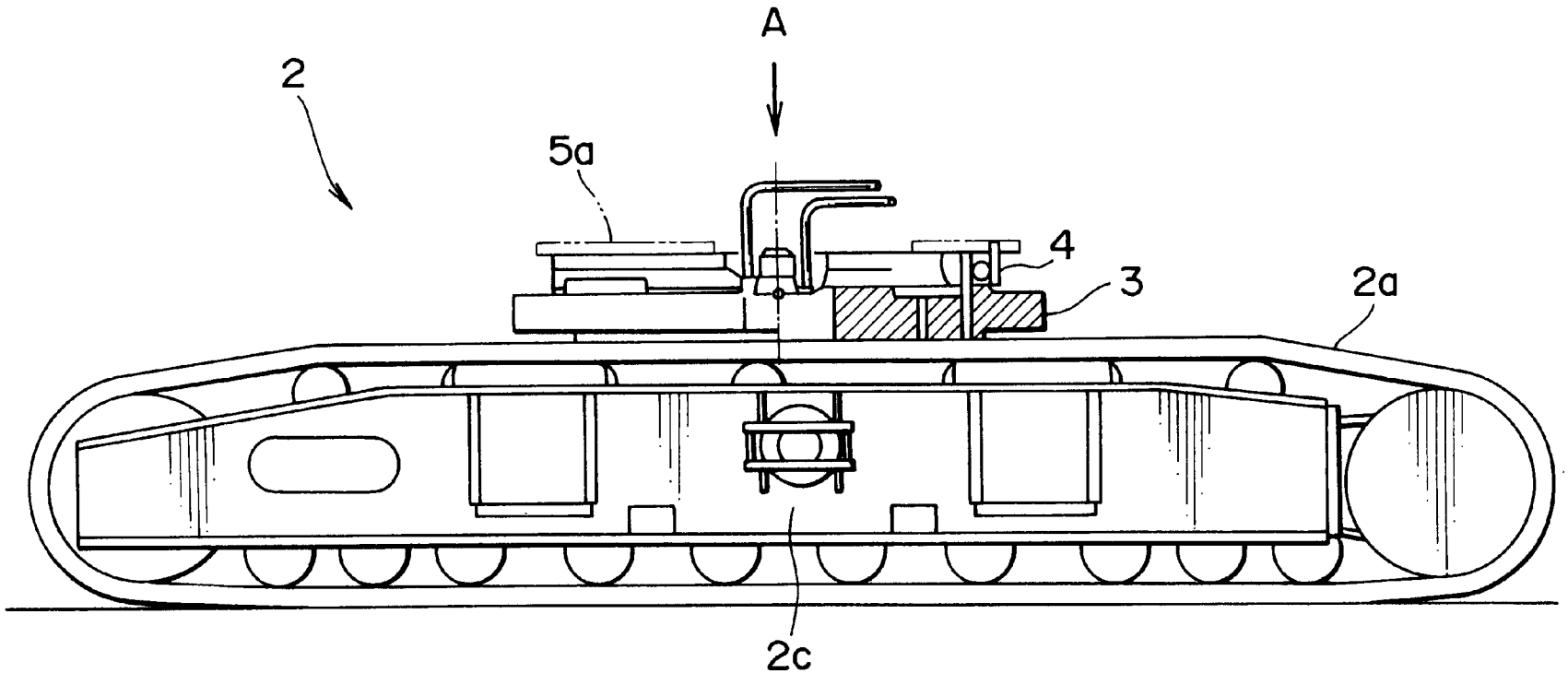
FIG. 2 is a side view of a lower traveling body of a crawler crane according to an embodiment of the present invention.
Figure 3:
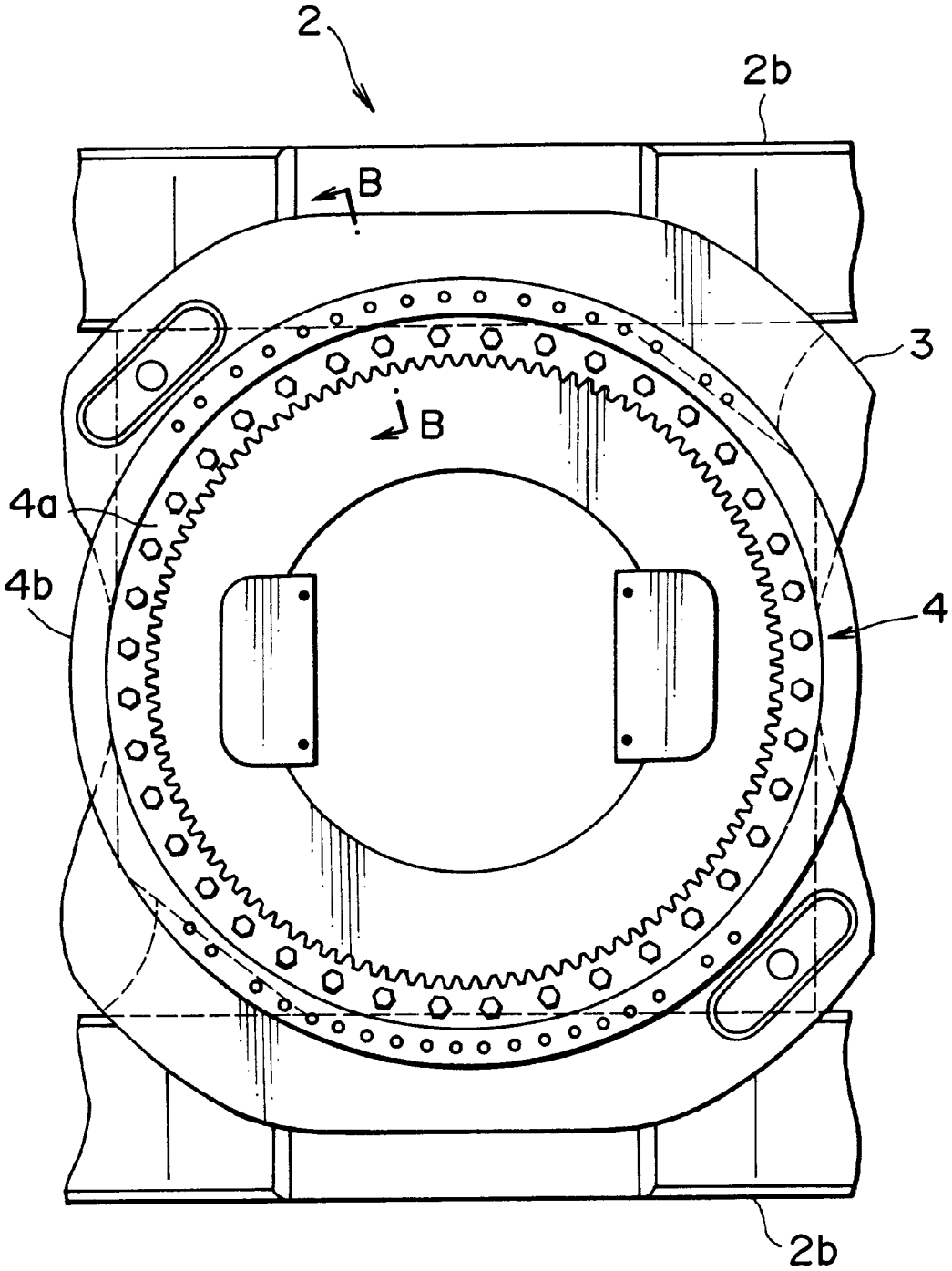
FIG. 3 is a view taken on A of FIG. 2.
Figure 4:
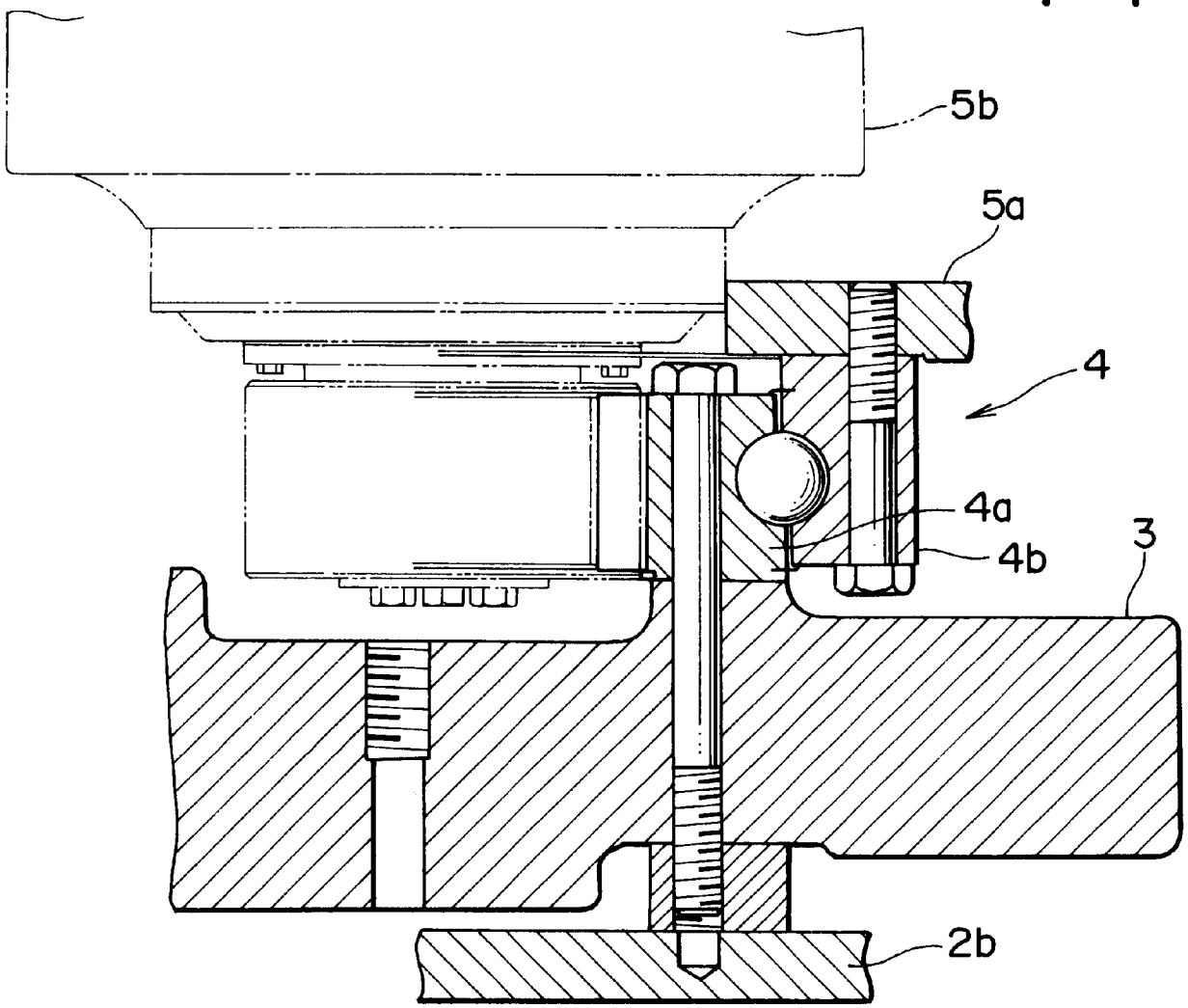
FIG. 4 is a sectional view taken on line B—B of FIG. 3.

In the following, the constitution of a crawler traveling type working machine according to the embodiment of the present invention will be described taking an example in which the working machine is a crawler crane. A description will be made with reference, successively, to FIG. 1A, the whole side view; FIG. 1B, a front view showing a state that a boom is removed; FIG. 2, a side view of a lower traveling body; FIG. 3, a view taken on A of FIG. 2 (in which a swivel joint, a hydraulic piping, and a crawler shoe are omitted); FIG. 4, a sectional view taken on line B—B of FIG. 3; and FIG. 5, a view taken on C of FIG. 1A.

First, the constitution of the crawler crane according to the present invention will be described with reference to FIGS. 1A and 1B. Reference numeral 1 shown in the drawing designates a crawler crane. The crawler crane 1 is provided with a lower traveling body 2 provided with crawlers 2*a* and 2*a* on left and right sides. A second counter weight 3 constituted as described below is mounted on the lower traveling body 2. On the weight 3 is mounted a rotating bearing 4 which is one kind of rotating means in which an outer race and an inner race provided with an internal gear are assembled through a ball. An upper rotating body 5 is mounted on the rotating bearing 4. Reference numeral 2*c* designates a crawler frame.

A main winding winch 7 is mounted on the upper rotating body 5. A boom. 6 is mounted to be risen and fallen on the upper rotating body 5. A guide sheave 6*b* and a top sheave 6*a* are provided at the extreme end of the boom. 6. A main winding rope 8 is stretched from the winch 7 through the sheaves 6*a*, 6*b*. The winch 7 winds up and rewinds the main winding rope 8 to elevate a main hook 8*a* for hanging an article. There is further mounted a boom rising and falling winch (see FIG. 5) 10 for winding up and rewinding a boom rising and falling rope 11 for rising and falling the boom 6 through a guide cable 9 one end of which is connected to a part near the upper end of the boom 6.

A triangular part projected to the rear upper part of a cabin 5*c* of the upper rotating body 5 is a gantry 12 for supporting the rising and falling force of the boom 6. Further, a part one end of which is connected to a position lower than the middle of the boom 6 (near the extreme end of the proximal boom) and lower end of which is connected onto the upper rotating body 5 is a backstop 13 for detecting the maximum angle of the boom 6.

The second counter weight 3 is a weight (an insert weight) inserted between the upper part of the body of the lower traveling body and the rotating bearing. The insertion of the weight improves the stability of the working machine. The weight 3 is inserted whereby the upper rotating body assumes a higher position by the height of the weight 3 to make the ground height of the first counter weight high, thus enabling to expect accompanying effect that the obstacle avoiding function when the upper traveling body rotates is improved. For this reason, the weight 3 can serve as the height adjusting function of the upper rotating body. The weight 3 is formed substantially in the form of an annulus having a punched hole in the central part and having a wing part projecting laterally of the lower traveling body 2, and is secured onto the car body 2*b* of the lower traveling body 2 by means of a bolt, as shown in FIGS. 2 to 4. The lower surface of the weight 3 is set to be a position higher than the upper surface of the crawler 2*a* of the lower traveling body 2.

An inner race 4*a* of the rotating bearing 4 is secured to the weight 3 by means of a bolt. A frame 5*a* of the upper rotating body 5 is secured to the outer race 4*b* by means of a bolt. The upper rotating body 5 is designed so that a pinion fitted over an output shaft of a rotating motor 5*b* mounted on the frame 5*a* is meshed with an internal gear of the inner race 4*a* of the rotating bearing 4 whereby the upper rotating body 5 is rotated.

Figure 5:
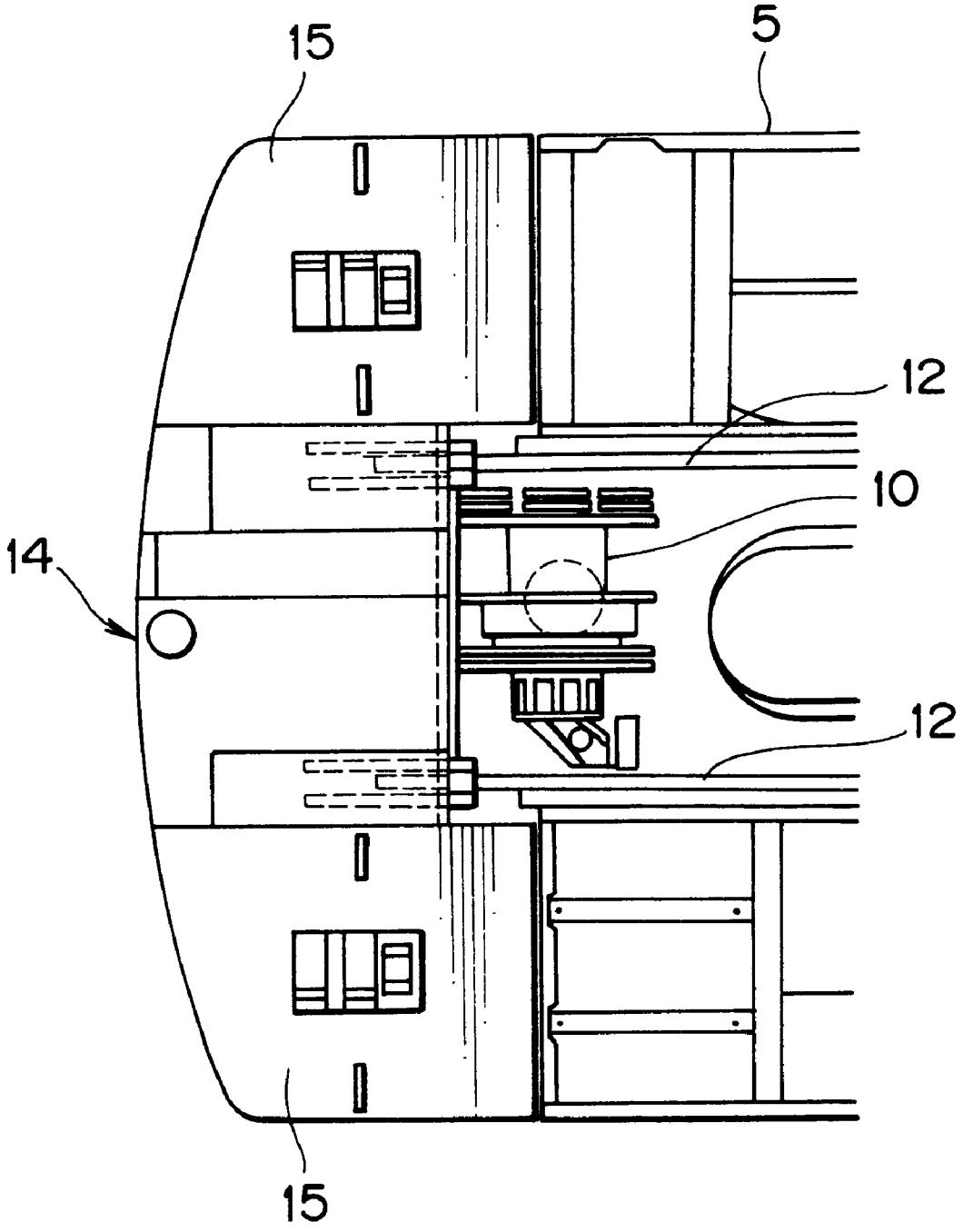
FIG. 5 is a view taken on C of FIG. 1A.

Further, a first counter weight 14 in the form of three layers is mounted on the rear end of the upper rotating body 5, as shown in FIGS. 1 and 5, and auxiliary counter weights 15, 15 are mounted on the counter with 14 and widthwise of the upper rotating body 5, respectively. While in the present embodiment, the first counter weight 14 is of the three-layer construction, it is noted that four layers or more may be employed. The number of layers is not limited.

The size of the body of the crawler crane 1 is set to the size of a 65-ton class (hanging class), for example, and the winding up ability of the main winding winch 7 and the boom rising and falling winch 10 is set to be equal to the winding up ability of the winding up winch and the boom rising and falling winch mounted on the crawler crane of a 80-ton class (one class up). Of course, the winding up ability can be increased by increasing the number of rope-stretching, and so, the winding up ability of the main winding winch 7 and the boom rising and falling winch 10 can be also enhanced.

The operation of the crawler crane 1 will be described hereinafter. The second counter weight 3 is provided between the upper part of the car body 2*b* of the lower traveling body 2 and the rotating bearing 4, and the auxiliary counter weights 15, 15 are provided on the first counter weight 14, and therefore, the stability of the crawler crane 1 is enhanced. Further, since the upper rotating body 5 assumes a higher position and the ground height of the first counter weight 14 becomes high, the obstacle avoiding function when the upper rotating body 5 rotates is improved. Further, the winding up ability of the main winding winch 7 and the boom rising and falling winch 10 is set to be equal to the winding up ability of the winding up winch and the boom rising and falling winch mounted on the crawler crane of a 80-ton class (one class up). Therefore, the hanging ability is excellent. That is, the stability of the body and the obstacle avoiding function are excellent as compared with the crawler crane of which size is of equal class, and the hanging ability is excellent. Therefore, despite the fact that the crawler crane 1 is compact, the working ability which is more excellent than the crawler crane of which size is equal thereto can be given.

The lower surface of the second counter weight 3 is set to a position higher than the upper surface of the crawlers 2*a*, 2*a* of the lower traveling body 2. Therefore, in carrying, the left and right crawlers 2*a*, 2*a* can be retreated without being interfered by the second counter weight 3. In addition, the size of the body of the crawler 1 is set to the size of 65-ton class while having a 80-ton class, and therefore, carrying can be made by a trailer by removing the end boom and the first counter weight 14 similarly to the case of the crawler crane of 65-ton hanging class. Because of this, work such as removal of the crawler, as in the crawler crane of 80-ton class, is unnecessary to contribute to reduction in carrying costs.

Even a field is so narrow that the crawler crane of 80-ton class cannot be set despite a field requiring the crawler crane of 80-ton class, the rear rotating radius of the crawler crane 1 according to the present embodiment is of ordinary 65-ton class. This can greatly contribute to the enhancement of the work efficiency in many narrow fields. Further, since as described above, the body of the crawler crane 1 is more compact than the body of the crawler crane having the ability equal thereto, and therefore, there is an economical effect that the maintenance costs can be reduced.

Incidentally, there are some users who desire to purchase crawler cranes of not only 80-ton class but also 65-ton class. In that case, assembly can be made without using the second counter weight 3 and the auxiliary counter weights 15, 15, and various devices can be used in common despite the fact that classes are different, and therefore, an inventory by makers is easy, a supply of parts is enhanced, and there is an effect capable of contributing to the reduction in maintenance costs.

While in the crawler crane 1 according to the present embodiment, the second counter weight 3 and the auxiliary counter weights 15, 15 are used as described above, it is noted that the enhancement of stability can be expected by using any one of these counter weights. Further, it is noted that the thickness of weights constituting the first counter weight 14 may be increased to increase the weight, without using the auxiliary counter weights 15, 15. Further, it is noted that the lateral dimension of the counter weight 14 may be increased to increase the weight. However, when the lateral dimension of the counter weight 14 is increased, the point of the rear rotating radius is disadvantageous, and therefore, the lateral dimension of the counter weight 14 may be set so as to be smaller than the rear rotating radius of the crawler crane of one class up.

A description has been made, as an example, of the case where the crawler traveling type working machine is a crawler crane. However, not limiting thereto, but the technical idea of the present invention can be applied to various crawler traveling type working machines for performing longitudinal hole excavation work, earth and sand excavation work and piling work, etc.

I claim:

1. A crawler traveling working machine, comprising:

a lower traveling body provided with crawlers on left and right sides;

an upper rotating body mounted on said lower traveling body, said upper rotating body having a first counter weight;

a boom mounted on said upper rotating body so as to be able to rise and fall;

a rotating joint, including a bearing having bearing races, rotatably mounting said upper rotating body on said lower traveling body;

a second counter weight interposed between an upper part of said lower traveling body and said rotating joint, wherein said second counter weight is substantially annular and supports at least one bearing race of said rotating joint, and has a laterally extending wing part projecting laterally of the lower traveling body.

2. The crawler traveling working machine, according to claim 1, further comprising a winch for winding up and rewinding a rope mounted on said upper rotating body.

3. The crawler traveling working machine, according to claim 1, wherein a lower surface of said second counter weight is set so as to assume a position higher than an upper surface of said crawlers.

4. A crawler traveling working machine comprising:

a lower traveling body provided with crawlers on left and right sides;

an upper rotating body mounted on said lower traveling body through a rotating joint, said upper rotating body having a first counter weight;

a second counter weight interposed between an upper part of said lower traveling body and said rotating joint, wherein said second counter weight is substantially annular and has a laterally extending wing part projecting laterally of the lower traveling body, further comprising an auxiliary counter weight provided on said first counter weight.

5. A crawler traveling working machine, comprising:

a lower traveling body provided with crawlers on left and right sides;

an upper rotating body mounted on said lower traveling body through a rotating joint, said upper rotating body having a first counter weight; and a second counter weight interposed between an upper part of said lower traveling body and said rotating joint, wherein a lower surface of said second counter weight is positioned higher than an upper surface of said crawlers, wherein said second counter weight is substantially annular and has a laterally extending wing part projecting laterally of the lower traveling body.

6. A crawler traveling working machine, comprising:

a lower traveling body provided with crawlers on left and right sides;

an upper rotating body mounted on said lower traveling body, said upper rotating body having a first counter weight;

a rotating joint, including a bearing having bearing races, rotatably mounting said upper rotating body on said lower traveling body;

a second counter weight interposed between an upper part of said lower traveling body and said rotating joint, wherein said second counter weight is substantially annular and supports at least one bearing race of said rotating joint, and has a laterally extending wing part projecting laterally of the lower traveling body.

* * * * *